US005718075A

United States Patent [19]

Johnson

[11] Patent Number: 5,718,075

[45] Date of Patent: Feb. 17, 1998

[54] RETAINING SLING SWIVEL

[76] Inventor: David A. Johnson, P.O. Box 12204, Salem, Oreg. 97309

[21] Appl. No.: 571,458

[22] Filed: Dec. 13, 1995

Related U.S. Application Data

[63] Continuation of Ser. No. 332,700, Nov. 1, 1994, Pat. No. 5,501,025.

[51] Int. Cl.[6] ..... F41C 33/00

[52] U.S. Cl. ..... 42/85; 224/150; 24/2.5

[58] Field of Search ..... 42/85; 224/150; 24/2.5, 122.3; 57/232

[56] References Cited

U.S. PATENT DOCUMENTS

| | | | |
|---|---|---|---|
| 2,057,881 | 10/1936 | Creamer | 24/122.3 |
| 4,562,945 | 1/1986 | Erlandson | 224/150 |
| 4,640,179 | 2/1987 | Cameron | 57/232 |
| 4,760,944 | 8/1988 | Hughes | 224/205 |

*Primary Examiner*—Michael J. Carone

*Attorney, Agent, or Firm*—Marger, Johnson, McCollom & Stolowitz, P.C.

[57] ABSTRACT

An improvement for retaining sling swivels on a firearm where web or narrow fabric is used in place of cord. Holes in an outer retaining piece and an inner cushioning piece can be of any shape. An extending projection may be used in the holes to conform the web or narrow fabric to the openings in the sling swivel.

In another embodiment, a wire may be enclosed in a closed web loop. A tab, which is folded and stitched, is formed adjacent to an outer retaining piece.

14 Claims, 1 Drawing Sheet

RETAINING SLING SWIVEL

This is a continuation of application Ser. No. 08/332,700 filed Nov. 1,1994 U.S. Pat. No. 5,501,025.

BACKGROUND OF THE INVENTION

1. Field of the Invention

This invention relates to retaining sling swivels on a firearm and, more particularly, using web material to retain sling swivels on a firearm.

2. Prior Art

The prior art uses primarily cord material to retain sling swivels by means of loop locks or outer retaining piece. The cord is more difficult to attach to the sling and the interface is weaker than when web material is used. The cord is also more difficult to install through swivels.

SUMMARY OF INVENTION

An improvement for retaining sling swivels on a firearm where web or narrow fabric is used in place of cord. Holes in an outer retaining piece and an inner cushioning piece can be of any shape. An extending projection may be used in the holes to conform the web or narrow fabric to the openings in the sling swivel.

In another embodiment, a wire may be enclosed in a closed web loop. A tab, which is folded and stitched, is formed adjacent to an outer retaining piece.

DESCRIPTION OF THE PREFERRED EMBODIMENT

Figure 1:
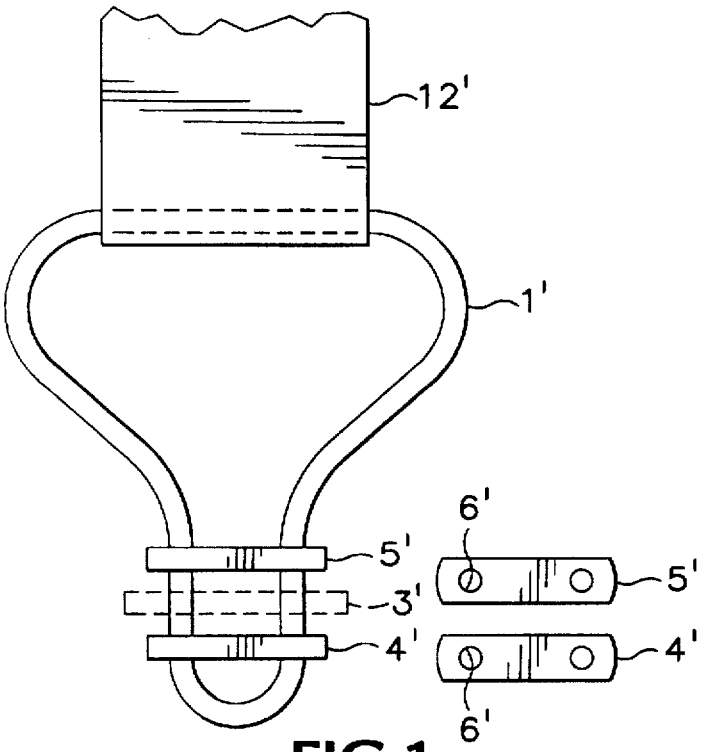
FIG.1 (PRIOR ART)
FIG. 1 shows the prior art in a front view showing the cord.
Figure 3:
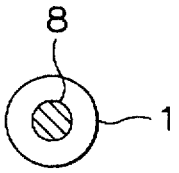
FIG. 3 shows the narrow fabric with insert along lines 3—3 of FIG. 2.

On a firearm 2 a sling 12 is attached by means of sling swivel 3. A closed narrow fabric loop 1(*a*) is attached to each end of the sling 12. The outer retaining piece 4 and the inner cushioning piece 5 are attached to the closed narrow fabric loop 1(*a*) before attachment to the sling 12. Each outer retaining piece 4 and inner cushioning piece 5 has two holes 6. The holes 6 may have an extending projection 7. The holes 6 may be of any shape, but a rectangular shape is preferred. The holes 6 also conform to said closed narrow fabric loop 1(*a*) to fit through sling swivel 3. The inner cushioning piece 5 prevents noise and damage to the firearm 2 by the sling swivel 3. The closed narrow fabric loop 1(*a*) can be hollow and an insert 8 can be used in the hollow tube.

In another embodiment the closed narrow fabric loop 1 is supplemented with material having a melting temperature greater than 500 degrees Fahrenheit. This narrow fabric loop 1 may be hollow with a wire 23 through the loop 1. A connector 20 is stitched and folded and looped through a buckle 21. The buckle 21 will pass through the swivel 3 but cannot be backed out unless manipulated. A pull tab 22 can be added to more easily pass the buckle 21 through the swivel 3.

Figure 4:
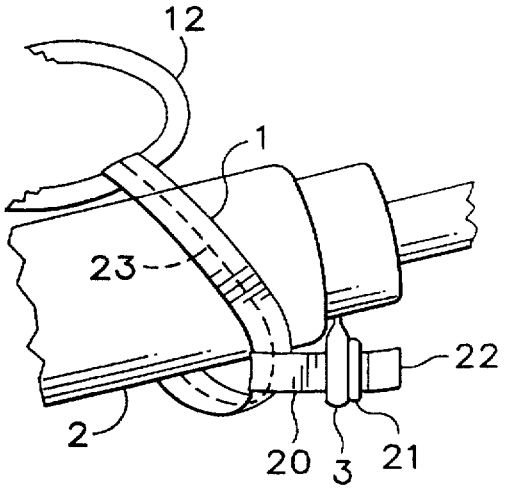
FIG. 4 shows another embodiment of the invention.
Figure 2:
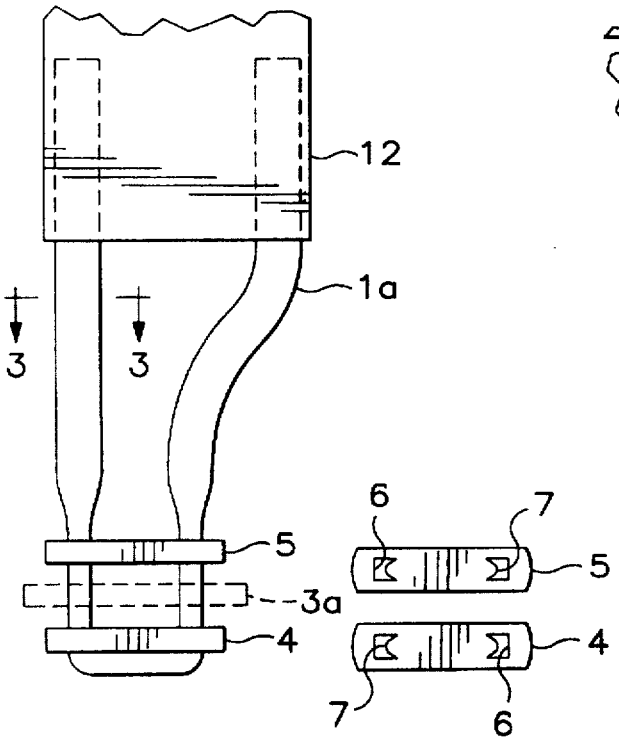
FIG. 2 shows the invention in a front view.

The invention is embodied in a sling which employs either one or both of the embodiments shown in FIGS. 2 and 4. The embodiment shown in FIG. 2 is preferably used to support a rear portion of the firearm, although it is not so limited. The embodiment shown in FIG. 4 is preferably used to support a front portion of the firearm, but again is not limited thereto.

I claim:

1. A sling for use with a gun having front and rear slotted swivels comprising:

an elongate shoulder strap (12) having front and rear ends;

a fabric loop (1) connected to the shoulder strap front end;

a first strap segment (20) connected to the first fabric loop (1) and to a retainer (21), the retainer and first strap segment passable through, and interlockingly engageable with, the slotted front sling swivel (3);

a rear retainer (4) passable through a slot in the rear sling swivel (3*a*) the retainer also having a pair of spaced apart slots (6,7);

a pliable stock support (1*a*) threaded through the rear retainer slots, the pliable stock support (1*a*) having flattened portions adjacent the rear retainer slots, and having first and second flattened ends connected to the shoulder strap rear end; and the rear retainer and the flattened stock support portions adjacent each retainer slot having a combined thickness which is less than the height of the rear sling swivel slot.

2. The sling of claim 1 wherein the pliable stock support comprises a hollow tubular member.

3. The sling of claim 2 further comprising first and second stiffening members received within the pliable stock support between the respective first and second flattened ends and the retainer.

4. The sling of claim 1 wherein the first fabric loop is a hollow, tubular fabric loop, and which further comprises an inner member (23) disposed within the looped member.

5. The sling of claim 4 wherein the inner member (23) is formed from a material having a melting temperature greater than about 500° F.

6. The sling of claim 5 wherein the inner member comprises a material selected from the group consisting of copper, iron, aluminum, brass, and steel.

7. The sling of claim 1 wherein the retainer comprises a generally planar buckle.

8. The sling of claim 1 which further comprises a tab (22) having a first end connected to the retainer and a distal end passable through the slotted sling swivel.

9. A sling for use with a gun having a slotted sling swivel comprising:

an elongate shoulder strap (12) having a first end;

a fabric loop (1) connected to the shoulder strap first end; and a first strap segment (20) connected to the first fabric loop (1) and to a retainer (21), the retainer and first strap segment passable through, and interlockingly engageable with, the slotted sling swivel (3).

10. The sling of claim 9 wherein the first fabric loop is a hollow, tubular fabric loop, and which further comprises an inner member (23) disposed within the looped member.

11. The sling of claim 10 wherein the inner member (23) is formed from a material having a melting temperature greater than about 500° F.

12. The sling of claim 11 wherein the inner member comprises a material selected from the group consisting of copper, iron, aluminum, brass, and steel.

13. The sling of claim 10 wherein the retainer comprises a generally planar buckle.

14. The sling of claim 10 which further comprises a tab (22) having a first end connected to the retainer and a distal end passable through the slotted sling swivel.

* * * * *

UNITED STATES PATENT AND TRADEMARK OFFICE

CERTIFICATE OF CORRECTION

PATENT NO. : 5,718,075
DATED : February 17, 1998
INVENTOR(S) : Johnson

It is certified that error appears in the above-identified patent and that said Letters Patent is hereby corrected as shown below:

Title reads "RETAINS SLING SWIVEL," should read -- IMPROVEMENT FOR RETAINING SLING SWIVEL --.

Signed and Sealed this

Eighteenth Day of December, 2001

*Attest:*

*Attesting Officer*

JAMES E. ROGAN
*Director of the United States Patent and Trademark Office*